United States Patent [19]

Walker

[11] Patent Number: 4,778,070

[45] Date of Patent: Oct. 18, 1988

[54] TAMPER-EVIDENT BOTTLE CAP COVER

[76] Inventor: James Walker, 1633 Earlington Rd., Havertown, Pa. 19083

[21] Appl. No.: 41,461

[22] Filed: Apr. 23, 1987

[51] Int. Cl.[4] ..... B65D 41/00

[52] U.S. Cl. ..... 215/232; 215/32; 215/251; 215/257; 220/377

[58] Field of Search ..... 215/232, 251, 32; 220/257, 377

[56] References Cited

U.S. PATENT DOCUMENTS

| | | | |
|---|---|---|---|
| 818,984 | 4/1906 | Solatinow | 215/32 |
| 836,539 | 11/1906 | Smith | 215/32 |
| 859,100 | 7/1907 | Niles | 215/32 |
| 2,021,084 | 11/1935 | Nutter | 215/251 |
| 4,091,949 | 5/1978 | Fowles et al. | 215/232 |
| 4,093,093 | 6/1978 | Fowles et al. | 215/251 |
| 4,171,236 | 10/1979 | Winchell et al. | 215/232 |

*Primary Examiner*—Stephen Marcus
*Assistant Examiner*—Nova Stucker
*Attorney, Agent, or Firm*—Steele, Gould & Fried

[57] ABSTRACT

A bottle cap cover is disclosed. In a bottle with a rounded and threaded neck, a circumferential collar is placed around the neck. Extending upward perpendicularly from the collar is a plurality of frangible pins. An overcap, with a top and side wall, has a plurality of apertures in its top. When pins are sealed at one pin end in the overcap top's apertures and at the other pin end to the collar, twisting of the overcap breaks the pins to give evidence of tampering.

11 Claims, 2 Drawing Sheets

TAMPER-EVIDENT BOTTLE CAP COVER

BACKGROUND OF THE INVENTION

1. Field of the Invention

This invention relates to containers, and more particularly to a bottle cap cover.

2. Description of the Prior Art

There are many containers on the market; of those, many are intended for medicines and the like. Because of the danger of a child or other unauthorized person taking the medicine, manufacturers have designed bottle caps which are difficult to remove. However, this did not stop the possibility of a person opening the bottle and removing or tampering with the contents.

Some of these medicine bottles are claimed to be tamper-proof and achieve this state by having outer seals around the neck and cap. But most containers are really tamper -evident, and are often quite complicated or bulky. One such container is shown in Hoag (U.S. Pat. No. 4,426,004) which discloses a tamper-evident container which completely encloses a medicine bottle. Two box-like portions are connected by frangible portions. To get at the bottle, the box-like portions are broken apart. Another patent (Colella, U.S. Pat. No. 3,820,654) discloses a safety container which uses a key to open the container. Zyksoski (U.S. Pat. No. 3,437,796) discloses a tamper-evident container for syringes which employs a breakable cap over each syringe.

None of these prior art patents shows a container with only a separate overcap to protect the bottle cap, to give unmistakable evidence of tampering, and to be easy for the intended user to open.

SUMMARY OF THE INVENTION

The aforementioned prior art problems are obviated by the tamper-evident bottle cap cover of the present invention. In the preferred embodiment, a conventional rounded bottle with a threaded neck and threaded cap is preferably fitted with a circumferential toroidal collar around the neck of the bottle. Spaced apart frangible pins are attached at one pin end to the collar and extend upwardly from the collar to form a fence around the bottle cap. An overcap preferably includes apertures to receive the other pin ends and is sealed to the pin ends. In order to open the bottle, the overcap is twisted, breaking the pins to allow access to the bottle cap and give evidence of tampering. The collar and pins may be sealed to each other and the bottle, preferably by heat sealing, as is known in the art; or they may be unitary with the bottle, such as a single plastic molded unit.

It is, therefore, an object of this invention to provide a bottle cap cover which is easy to open and yet still gives unmistakable evidence of tampering.

It is another object of this invention to provide a bottle cap cover which utilizes a toroidal collar and overcap sealed to frangible pins.

It is still another object of this invention to provide a bottle cap cover which employs heat sealing to seal the members to each other.

It is yet another object of this invention to provide a bottle cap cover which is attractive and which does not make the bottle bulky or unwieldy for the intended user.

It is a further object of this invention to provide a bottle cap cover which gives evidence of tampering by the breaking of frangible pins.

It is still a further object of this invention to provide a bottle cap cover which is easily applicable to any standard bottle now on the market without great expense of adaptation.

These and other objects will be more readily ascertainable to one skilled in the art from a consideration of the following Figures, description and exemplary embodiments.

BRIEF DESCRIPTION OF THE DRAWING(S)

DETAILED DESCRIPTION OF THE PREFERRED EMBODIMENT(S)

Figure 1:
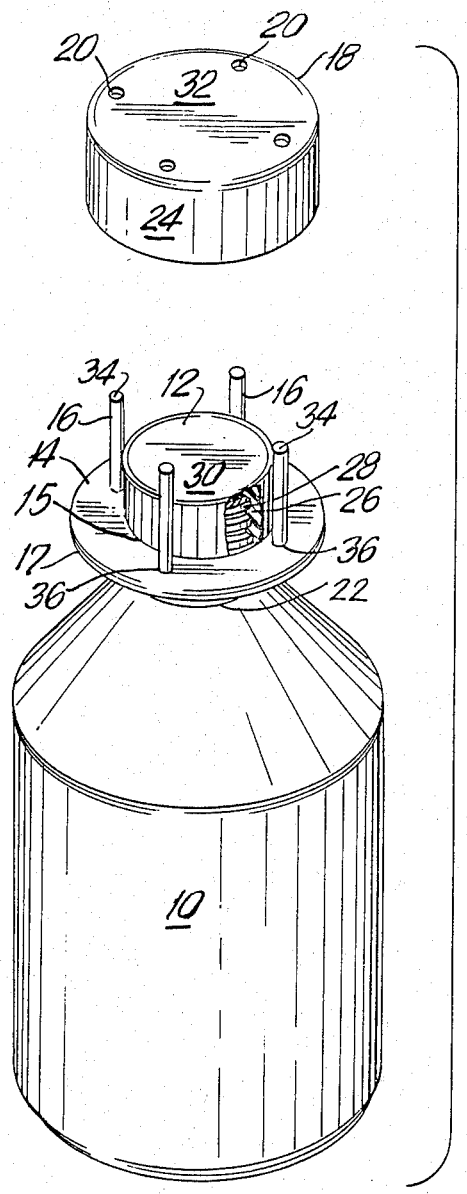
FIG. 1 shows a bottle with an exploded view of the improved bottle cap cover of this invention.

Referring now to the drawings, and more particularly to FIG. 1, bottle 10 is seen as a conventional bottle, such as a medicine containing bottle, with a narrow, rounded neck area and a threaded cap 12. Bottle neck 22, with threads 28 meshed with threads 26 of cap 12, (seen more clearly in FIGS. 3 and 4) is fitted with collar 14 which has inner collar edge 15 and outer edge 17. Preferably, collar 14 is sealed to neck 22 at inner collar edge 15 by heat sealing, or molded together with the bottle, as is known in the art. Collar 14 is seen fitted with four pins 16 which are also preferably heat sealed to, or molded at, pin ends 36 with collar 14. Although only four pins 16 are shown for clear illustration, it should be understood that the number of pins preferred is not critical, but should be sufficient to insure that cap 12 cannot be grasped by fingers without breaking of pins 16. A portion of cap 12 is shown cut-away so that thread 28 on neck 22 and threads 26 on cap 12 can be seen.

Overcap 18 is seen having circumferential side wall 24 and top 32. Side wall 24 is preferably of a depth equal to the length of pins 16, so that, when assembled, overcap 18 rests on collar 14. Top 32 is seen having four apertures 20, one to receive each pin 16.

In use, bottle 10 is filled; cap 12 is turned onto neck 22; and overcap 18 is fitted onto pins 16 to rest on collar 14. Overcap 18 is then sealed to pin ends 34, preferably by heat sealing. When overcap 18 is turned to open, pins 16 are broken, giving evidence of tampering.

Although FIG. 1, and the other figures, illustrate an overcap 18 with side wall 24, side wall 24 may be eliminated. In such an embodiment, pin ends 34 are sealed to the underside of overcap top 32. Also, although collar 14 is preferred, bottle 10 and other differently shaped bottles may not require use of a collar. In such an embodiment, pin ends 36 may be sealed directly to bottle 10. Of importance is that pins 16 be sealed at one end to a bottle, or extension of a bottle, and at the other pin end to an overcap.

Figure 2:
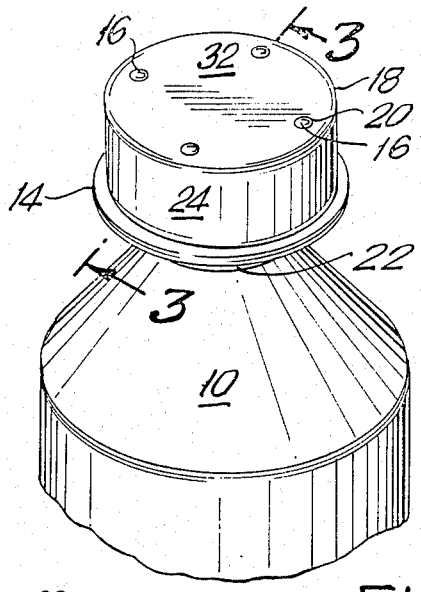
FIG. 2 is an enlarged view of the bottle cap cover in position on a bottle, the pins sealed in the overcap apertures.

Now referring to FIG. 2, an embodiment is shown with collar 14, pins 16 and bottle 10 molded together as one unit. Overcap 18, with top 32 and side wall 24, is seen with pins 16 sealed in apertures 20. In the mode illustrated in FIG. 2, bottle cap 12 (unseen) is completely inaccessible. If a person wants to reach the contents of bottle 10, he must twist overcap 18, which will break pins 16. Yet, in this mode, bottle 10 is not unattractive, needlessly bulky, or difficult for the intended user to open.

Figure 3:
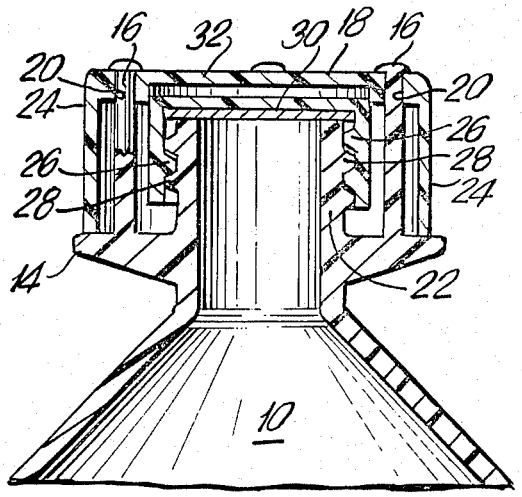
FIG. 3 is a cross section taken on lines 3—3 of FIG. 2 to show the pins, collar and bottle as unitary, the overcap sealed, and the pins unbroken.

Now referring to FIG. 3, taken on lines 3—3 of FIG. 2, a partial view of bottle 10 and the cover of this invention are shown in cross section. Bottle 10 has neck 22, with threads 28. In the embodiment of FIGS. 2 and 3, collar 14 is shown as one piece with neck 22. Bottle cap 12 has threads 26 and top 30. Overcap 18 has top 32, side wall 24, and apertures 20. Pins 16 are seen in apertures 20, one pine 16 in partial cross section. Also in this embodiment, pins 16 are molded with collar 14, although they also may be heat sealed to collar 14. As with FIG. 2, the mode of FIG. 3 is that of a sealed bottle, pins intact and the contents of bottle 10 not violated.

Figure 4:
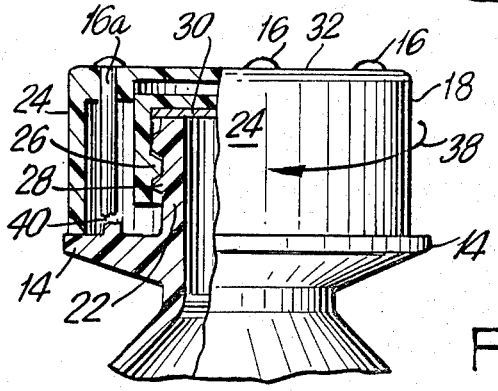
FIG. 4 is a cut-away illustrating the overcap as it is being unsealed, a pin shown broken.

Now referring to FIG. 4, a partial break-away of overcap 18, neck 22, collar 14, and cap 12 is shown to illustrate the mode of an opened overcap 18. Bottle neck 22 is seen with threads 28 and bottle cap 12 with threads 26 and top 30. Overcap 18 has top 32, apertures 20, and side wall 24. Pins 16 has been sealed inside apertures 20. Overcap 18 has been twisted in the direction of arrow 38 and pin **16*a* has been broken at break 40. Thus, once overcap 18 has been twisted, frangible pins 16** break, giving immediate and unmistakable evidence of tampering.

There are several variations which may be practiced in the scope of this invention. First collar and pins may be sealed to bottle 10, or collar, pins, and bottle may be molded as one unit. Second, overcap 18 may include apertures to receive pins 16, or pins 16 may be sealed to the underside of overcap top 32. Collar 14 may be provided, or pins 16 may extend directly from bottle 10. Overcap 18 may have a circumferential side, or it may simply be a flat cap.

Lastly, although a bottle with a threaded cap is used to illustrate the cap cover of this invention, the bottle itself is not part of the invention and any bottle neck and cap arrangement, including, for example, "snap-top" bottles and others in conventional use are within the scope of this invention.

There are many advantages to the bottle cap cover of this invention. Chiefly, the cover offers protection from tampering and evidence of tampering while remaining easy to open and unobtrusive. A bottle may easily be modified to accept the elements of the bottle cap cover, or the collar and pins of the cover may be molded with the bottle as one unit. Also, additional sealing between bottle cap and overcap, such as plastic film, may be added without interfering with the operation of the bottle cap cover of this invention.

Having now illustrated and described my invention, it is not intended that such description limit this invention, but rather that this invention be limited only by reasonable interpretation of the appended claims.

What is claimed is:

1. In a bottle with a neck and a cap releasably mated thereto, the improvement comprising a tamper-evident bottle cap cover, said cover including:

(a) a plurality of spaced frangible pins extending upwardly from said bottle generally perpendicular to a plane of the cap, the pins forming a fence around said bottle neck and cap, said pins being spaced by a predetermined spacing adequate to prevent removal of said bottle cap, said pins each having two ends, each said pin having a first end sealed to said bottle, each said pin having a second end sealed to an overcap, the overcap including a circumferential side wall of a depth generally equal to a length of said pins; and, (b) the overcap having a top and an underside and being sized to overfit said fence of pins, said overcap being sealed to said second ends of the pins, whereby when said overcap is turned, said pins break to give evidence of tampering.

2. The bottle cap cover according to claim 1 including, additionally, a generally toroidal collar having an inner and an outer edge and upper and lower surfaces, said collar's inner edge circumferentially sealed to the outer surface of the neck of said bottle, said first pin ends sealed to said collar upper surface proximate said collar outer edge.

3. The bottle cap cover according to claim 2 wherein said pins are sealed to said collar and to said overcap by heat sealing and wherein said collar is sealed to said bottle neck by heat sealing.

4. The bottle cap cover according to claim 1 wherein said overcap top includes a plurality of apertures to receive said pins' first ends.

5. The bottle cap cover according to claim 2 wherein said collar, pins and bottle are unitary.

6. A tamper-evident bottle cap cover comprising:

(a) a toroidal collar adapted to surround a bottle neck, said collar including a top surface and an underside, an inner edge and an outer edge;

(b) a plurality of spaced frangible pins sealed to and extending upward perpendicularly from an upper surface of said collar, each of the pins having two ends, a first pin end being attached to said collar proximate said outer edge of the collar and a second pin end being sealed to an overcap; and, (c) the overcap including a top and a circumferential side wall of a depth generally equal to a length of said pins, the overcap being sized to overfit said pins, said overcap top including a plurality of apertures to sealably receive said second ends of the pins, the side wall of the overcap resting on said toroidal collar when said overcap is sealed to said pins, whereby when said overcap is turned to open, said pins break to give evidence of tampering.

7. In a conventional bottle with a rounded and threaded neck and a cap threaded thereto, the improvement comprising a tamper-evident bottle cap cover, said cover including:

(a) a generally toroidal collar having an inner and an outer edge, an upper surface and an underside, said collar's inner edge circumferentially sealed to the outer surface of the neck of said capped bottle;

(b) a plurality of spaced frangible pins sealed to and extending upward perpendicularly from said collar's upper surface to form a fence around said bottle cap and spaced to prevent removal of said bottle cap, each said pin having two ends, a first end attached to said collar proximate said collar's outer edge, a second pin end sealed to an overcap; and, (c) an overcap including a top and a circumferential side wall, said overcap sized to overfit said pins so that said side wall rests upon said collar, said overcap top including a plurality of apertures to sealably receive said pins' second ends, whereby when said overcap is turned to open, said pins break to give evidence of tampering.

8. The bottle cap cover according to claim 7 wherein said pins are heat sealed to said collar and said overcap.

9. The bottle cap cover according to claim 7 wherein said collar, said pins and said bottle are unitary.

10. In a bottle with a neck and a cap releasably mated thereto, the improvement comprising a tamper-evident bottle cap cover, said cover including:

(a) a plurality of spaced frangible pins extending upward generally perpendicularly from a top of said bottle to form a fence around said bottle neck and cap, the pins being close enough to prevent removal of said bottle cap between said pins, said pins each having two ends, a first pin end being sealed to said bottle and a second pin end being sealed to an overcap, said overcap being transparent; and, (b) the overcap having a top and an underside and being sized to overfit said fence of pins, said overcap underside being sealed to the second ends of the pins, whereby when said overcap is turned to open, said pins break to give evidence of tampering.

11. A tamper-evident bottle cap cover, comprising:

(a) a toroidal collar adapted to surround a bottle neck, said collar including a top surface and an underside, an inner edge and an outer edge;

(b) a plurality of spaced frangible pins sealed to and extending upward from an upper surface of said collar, each of the pins having two ends, a first end of the pins being attached to said collar proximate the outer edge of the collar and a second end of the pins being sealed to an overcap; and, (c) said overcap being transparent and including a top, the overcap being sized to overfit said pins, said overcap top including a plurality of apertures to sealably receive the second end of the pins, whereby when said overcap is turned to open, said pins break to give evidence of tampering.

* * * * *